US006429839B1

(12) United States Patent
Sakamoto

(10) Patent No.: US 6,429,839 B1
(45) Date of Patent: Aug. 6, 2002

(54) LIQUID CRYSTAL DISPLAY APPARATUS AND ELECTRONIC DEVICE FOR PROVIDING CONTROL SIGNAL TO LIQUID CRYSTAL DISPLAY APPARATUS

(75) Inventor: Atsushi Sakamoto, Yamabe-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/471,858

(22) Filed: Dec. 23, 1999

(30) Foreign Application Priority Data

Dec. 24, 1998 (JP) ..... 10-368044
Nov. 30, 1999 (JP) ..... 11-341464

(51) Int. Cl.[7] ..... G09G 3/36
(52) U.S. Cl. ..... 345/87; 345/99; 345/102
(58) Field of Search ..... 345/87, 89, 102, 345/213, 76, 77, 99, 94; 315/169.3; 349/61

(56) References Cited

U.S. PATENT DOCUMENTS 5,105,127 A * 4/1992 Lavaud et al.
5,122,791 A * 6/1992 Gibbons et al. ..... 345/87
5,184,117 A * 2/1993 Gauthier ..... 345/87
5,539,707 A * 7/1996 Wood ..... 345/102

FOREIGN PATENT DOCUMENTS

EP 0 406 116 A1 1/1991
EP 0 685 831 A1 12/1995
JP 3-64895 3/1991
JP 4-143722 5/1992

* cited by examiner

*Primary Examiner*—Regina Liang
(74) *Attorney, Agent, or Firm*—Dike, Bronstein, Roberts & Cushman IP Group Edwards & Angell, LLP; David C. Conlin; Timothy Carter Pledger

(57) ABSTRACT

A liquid crystal display apparatus includes a liquid crystal display device; a light source for illuminating the liquid crystal display device; a LCD device driving circuit for providing a driving voltage to the liquid crystal display device based on a display data signal and a plurality of liquid crystal driving signals including a display data latch signal; a dividing circuit for dividing a frequency of the display data latch signal by a factor of N so as to obtain a period which is N times as large as that of the display data latch signal, where N is an integer greater than zero; a duty control circuit for changing an ON duty ratio of the frequency-divided signal by using the frequency-divided signal as a reference frequency; and a light source driving circuit for turning the light source ON/OFF based on a signal from the duty control circuit having the ON duty ratio set in the duty control circuit, wherein, where a driving duty is (1/D), and a remainder of D divided by the integer N is A, each of the integer N and the value D is set to an integer greater than zero which satisfies the following expression:

$$-1 \leq \{(N/A)-2\} \leq 1.$$

8 Claims, 13 Drawing Sheets

VCC
10
YD
D PR Q
CLK
CL Q̄
81
S10
83
84
A S
B Y
S11
S12
B flip-flops
82
VCC
41
A
B
C
D
ENP
ENT
CLK
LOAD
CLR
QA
QB
QC
QD
RCO
46
42
VCC
43
S1
LP
44
45

LIQUID CRYSTAL DISPLAY APPARATUS AND ELECTRONIC DEVICE FOR PROVIDING CONTROL SIGNAL TO LIQUID CRYSTAL DISPLAY APPARATUS

BACKGROUND OF THE INVENTION

1. Field of the Invention

The present invention relates to a liquid crystal display (LCD) apparatus which is employed as a display apparatus incorporated in an information processing apparatus, an audio-video apparatus, an advertising indicator, etc. Furthermore, the present invention also relates to an electronic device for providing a control signal to the LCD apparatus.

2. Description of the Related Art

In recent years, personal computers and word processors have become widespread. As a display apparatus incorporated therein, a light-weight, thin LCD apparatus which may be driven by a battery has become dominant in the market replacing a CRT display apparatus which consumes a large amount of power and space.

A typical LCD apparatus employs a cold cathode ray tube as a light source for illuminating the display panel from the back, and the light source is driven by a light source driving circuit. The method for controlling the brightness in the display panel can generally be classified into two types of methods. One is a current-based light modulation method wherein the luminance is controlled by varying a current amplitude of the cold cathode ray tube. The other is a chopping light modulation method wherein the light source is alternately turned ON/OFF at a high speed based on a light modulation signal, and the luminance is virtually controlled by changing the duty ratio which is a ratio between an ON period and an OFF period of the light source.

The chopping method can accurately control the luminance over a wide brightness range. However, the frequency of flashing of the light used for the light modulation is apt to cause an interference with the driving frequency of the liquid crystal display device. As a result of the interference, flicker in the display and/or moving stripes are perceived on the screen.

In order to remove such drawbacks, various methods have been devised. Japanese Laid-Open Publication No. 4-143722 ("Prior Art 1.") discloses a backlight and a control method thereof. As shown in FIG. 12, a light modulation signal generation circuit 21 is provided in a stage preceding a light source driving circuit 26 for driving a cold cathode ray tube 2. The frequency of the light modulation signal of the light source driving circuit 26 is adjusted so that the shift-number and a shift direction factor of light/dark portions on the screen are slightly offset.

Japanese Laid-Open Publication No. 3-64895 ("Prior Art 2") discloses another control method for a backlight. A control device shown in FIG. 13 includes a duty control circuit 15 and a monostable multivibrator 11 coupled via an OR circuit 12 to a light source driving circuit 16 for driving a fluorescent lamp 2 which acts as a backlight of a liquid crystal display panel 1. The fluorescent lamp 2 is turned ON/OFF based on a rectangular wave signal whose duty cycle is variable. The rectangular wave signal is synchronized with a signal obtained by dividing a frequency of an image synchronization signal for a liquid crystal screen by an integer n (n>0).

According to Prior Art 1 (Japanese Laid-Open Publication No. 4-143722), a light modulation signal frequency Fb and a driving frequency Ff of an LCD apparatus are set independent of each other. Therefore, even when a value suitable for the light modulation signal frequency Fb is determined by way of calculation, there remains a difficulty in regulating the driving frequency Ff and the light modulation signal frequency Fb with high accuracy while maintaining a desirable relationship therebetween. Furthermore, even when these frequencies are initially set to appropriate values, respectively, aging of the LCD device, temperature variation, etc., may cause a frequency-shift, whereby flicker in the display is perceived on the screen.

Prior Art 2 (Japanese Laid-Open Publication No. 3-64895) discloses a method for synchronizing the light modulation signal with the liquid crystal driving signal as shown in FIG. 13. However, regarding the frequency of the light modulation signal, Prior Art 2 only describes "a signal corresponding to an image synchronization signal whose frequency is divided by an integer n equal to or greater than zero." Prior Art 2 fails to disclose specifically what type of signal the image synchronization signal is, and what number is optimal for the integer n. Therefore, even when a light modulation signal is obtained by suitably dividing the frequency of a horizontal synchronization signal having a driving cycle of one horizontal line or a display data latch pulse, which are used as liquid crystal driving signals, flicker in the display may be generated in many cases.

SUMMARY OF THE INVENTION

According to one aspect of the present invention, a liquid crystal display apparatus includes a liquid crystal display device: a light source for illuminating the liquid crystal display device; a LCD device driving circuit for providing a driving voltage to the liquid crystal display device based on a display data signal and a plurality of liquid crystal driving signals including a display data latch signal; a dividing circuit for dividing a frequency of the display data latch signal by a factor of N so as to obtain a period which is N times as large as that of the display data latch signal, where N is an integer greater than zero; a duty control circuit for changing an ON duty ratio of the frequency-divided signal by using the frequency-divided signal as a reference frequency; and a light source driving circuit for turning the light source ON/OFF based on a signal from the duty control circuit having the ON duty ratio set in the duty control circuit, wherein, where a driving duty is (1/D), and a remainder of D divided by the integer N is A, each of the integer N and the value D is set to an integer greater than zero which satisfies the following expression:

$$-1 \leqq \{(N/A)-2\} \leqq 1.$$

According to another aspect of the present invention, a liquid crystal display apparatus includes a liquid crystal display device; a light source for illuminating the liquid crystal display device; a LCD device driving circuit for providing a driving voltage to the liquid crystal display device based on a display data signal and a plurality of liquid crystal driving signals; a dividing circuit for dividing a frequency of a horizontal synchronization signal having a period of one horizontal period, to obtain a period which is N times as large as that of the a horizontal synchronization signal, where N is an integer greater than zero; a duty control circuit for changing an ON duty ratio of the frequency-divided signal by using the frequency-divided signal as a reference frequency; and a light source driving circuit for turning the light source ON/OFF based on a signal f rom the duty control circuit having the ON duty ratio set in the duty control circuit, wherein where a period of the vertical synchronization signal is M times as large as a period of the horizontal synchronization signal, and a remainder of M divided by N is A, each of the integer N and the value M is set to an integer greater than zero which satisfies the following expression:

$$-1 \leqq \{(N/A)-2\} \leqq 1.$$

According to still another aspect of the present invention, a liquid crystal display apparatus includes a liquid crystal display device; a light source for illuminating the liquid crystal display device; a LCD device driving circuit for providing a driving voltage to the liquid crystal display device based on a display data signal and a plurality of liquid crystal driving signals including a display data latch signal; a dividing circuit for dividing a frequency of the display data latch signal or a horizontal synchronization signal having a cycle of one horizontal period, to obtain a period which is M times as large as that of the display data latch signal or the horizontal synchronization signal, where M is an integer greater than zero; a duty control circuit for changing an ON duty ratio of the frequency-divided signal by using the frequency-divided signal as a reference frequency; and a light source driving circuit for turning the light source ON/OFF based on a signal from the duty control circuit having the ON duty ratio set in the duty control circuit, wherein, where a period of the display data latch signal or the horizontal synchronization signal is tLP, and a rising edge of a light modulation signal with respect to the beginning of a frame period is offset by (B×tLP), the value B is set to an integer greater than zero which satisfies the following expression:

$$-1 \leqq \{(M/B)-2\} \leqq 1.$$

According to still another aspect of the present invention, a liquid crystal display apparatus includes a liquid crystal display device; a light source for illuminating the liquid crystal display device; a LCD device driving circuit for providing a driving voltage to the liquid crystal display device based on a display data signal and a liquid crystal driving signal having a frame period T1; a duty control circuit for changing an ON duty ratio of a signal having a period T2; a light source driving circuit for turning the light source ON/OFF based on a signal having the ON duty ratio set in the duty control circuit, wherein, where a remainder of T1 divided by T2 is A, the division-number is set to an integer greater than zero which satisfies the following expression:

$$-1 \leqq \{(T2/A)-2\} \leqq 1.$$

According to still another aspect of the present invention, an electronic device for providing a control signal for use in a liquid crystal display apparatus, wherein, where a driving duty ratio is 1/D, a division-number of a display data latch signal to be used in the liquid crystal display apparatus is an integer N, and a remainder of D divided by the division-number N is A, each of the division-number N and the value D is set to an integer greater than zero which satisfies the following expression:

$$-1 \leqq \{(N/A)-2\} \leqq 1.$$

According to still another aspect of the present invention, an electronic device for providing a control signal for use in a liquid crystal display apparatus, wherein, where a division-number of a horizontal synchronization signal having a cycle of one horizontal period is an integer N, a cycle of a vertical synchronization signal to be used in the liquid crystal display apparatus is M times as large as that of a horizontal synchronization signal, and a remainder of the value M divided by the division-number N is A, each of the division-number N and the value M are set to an integer greater than zero which satisfies the following expression:

$$-1 \leqq \{(N/A)-2\} \leqq 1.$$

According to still another aspect of the present invention, an electronic device for providing a control signal for use in a liquid crystal display apparatus, wherein, where a period of a display data latch signal or a horizontal synchronization signal having a cycle of one horizontal period to be used in the liquid crystal display apparatus is tLP, and a rising edge of a light modulation signal with respect to the beginning of a frame period is offset by (B×tLP), the value B is set to an integer greater than zero which satisfies the following expression:

$$-1 \leqq \{(M/B)-2\} \leqq 1.$$

According to still another aspect of the present invention, an electronic device for providing a control signal for use in a liquid crystal display apparatus, wherein, where a frame period of the liquid crystal display apparatus is T1, a signal having an ON duty ratio to be changed has a period T2, and a remainder of Ti divided by T2 is A, the electronic device outputs the control signal while setting a division-number to an integer greater than zero which satisfies the following expression:

$$-1 \leqq \{(T2/A)-2\} \leqq 1.$$

Hereinafter, functions of the present invention will be described.

According to the above-described structure, the frequency of a display data latch signal for driving the liquid crystal display device or the frequency of a horizontal synchronization signal having a cycle of one horizontal period is divided by division-number N by a dividing circuit, and the frequency-divided signal is output to a duty control circuit. The duty control circuit changes the ON duty ratio of the frequency-divided signal, and outputs a signal having a modified duty ratio to a light source driving circuit. Based on the signal from the duty control circuit, the light source driving circuit drives the light source for illuminating the liquid crystal display device.

Herein, assuming that (1/D) is a driving duty ratio of the LCD apparatus, "A" is the remainder of D/N, and N is set so as to satisfy the following condition:

$$-1 \leqq \{(N/A)-2\} \leqq 1. \qquad \text{(Condition 1)}$$

Then, the light source is turned ON/OFF for each frame (i.e., with the frame frequency). The frame frequency is typically equal to or greater than 60 Hz. With such a high frequency, flicker in the display is not perceived by the human eye because the cycle of flashing is extremely fast. Accordingly, light for the display can be appropriately modulated.

Furthermore, even in the case where the frequency of the LCD device driving signal fluctuates due to aging of the LCD device and/or temperature variation, the light modulation signal synchronizes with the fluctuated frequency because the light modulation signal is obtained by dividing the frequency of a liquid crystal display device driving signal. Thus, a stable driving operation can be carried out independent of such frequency fluctuation. Accordingly, the light for the display is consistently maintained in a suitable state while flicker in the display is reduced.

Furthermore, the dividing circuit divides the frequency of a display data latch signal or the frequency of a horizontal synchronization signal having a period of "tLP" by a division-number M. A rising edge of the light modulation signal is offset with respect to the beginning of a frame period by (B×tLP) for each frame. The value B is set so as to satisfy the following expression:

$$-1 \leqq \{(M/B)-2\} \leqq 1.$$

Thus, the light source is turned ON/OFF for each frame based on a frame frequency in a manner similar to that under condition 1.

Thus, for the same reasons as those described above, flicker is not perceived by the human eye while the light can be appropriately modulated. Furthermore, even in the case where the frequency fluctuates due to aging and/or temperature variation, a stable driving can be performed without being affected by such a frequency fluctuation.

Especially in the case of frequency fluctuation, the value B can be set independent of the relationship between the division-number M and the driving duty ratio. Accordingly, flicker in the display can be reduced under a wider variety of conditions.

Thus, the invention described herein makes possible the advantage of providing an LCD apparatus capable of suppressing the generation of flicker in the display and capable of maintaining a stable display with reduced flicker even when the driving frequency and/or the light modulation signal frequency fluctuate due to aging of the LCD apparatus and/or temperature variation.

This and other advantages of the present invention will become apparent to those skilled in the art upon reading and understanding the following detailed description with reference to the accompanying figures.

DESCRIPTION OF THE PREFERRED EMBODIMENTS

Next, embodiments of the present invention will now be described with reference to the drawings.

(Embodiment 1)

A liquid crystal display (LCD) apparatus according to Embodiment 1 of the present invention will be described with reference to FIGS. 1 through 6C.

Figure 1:
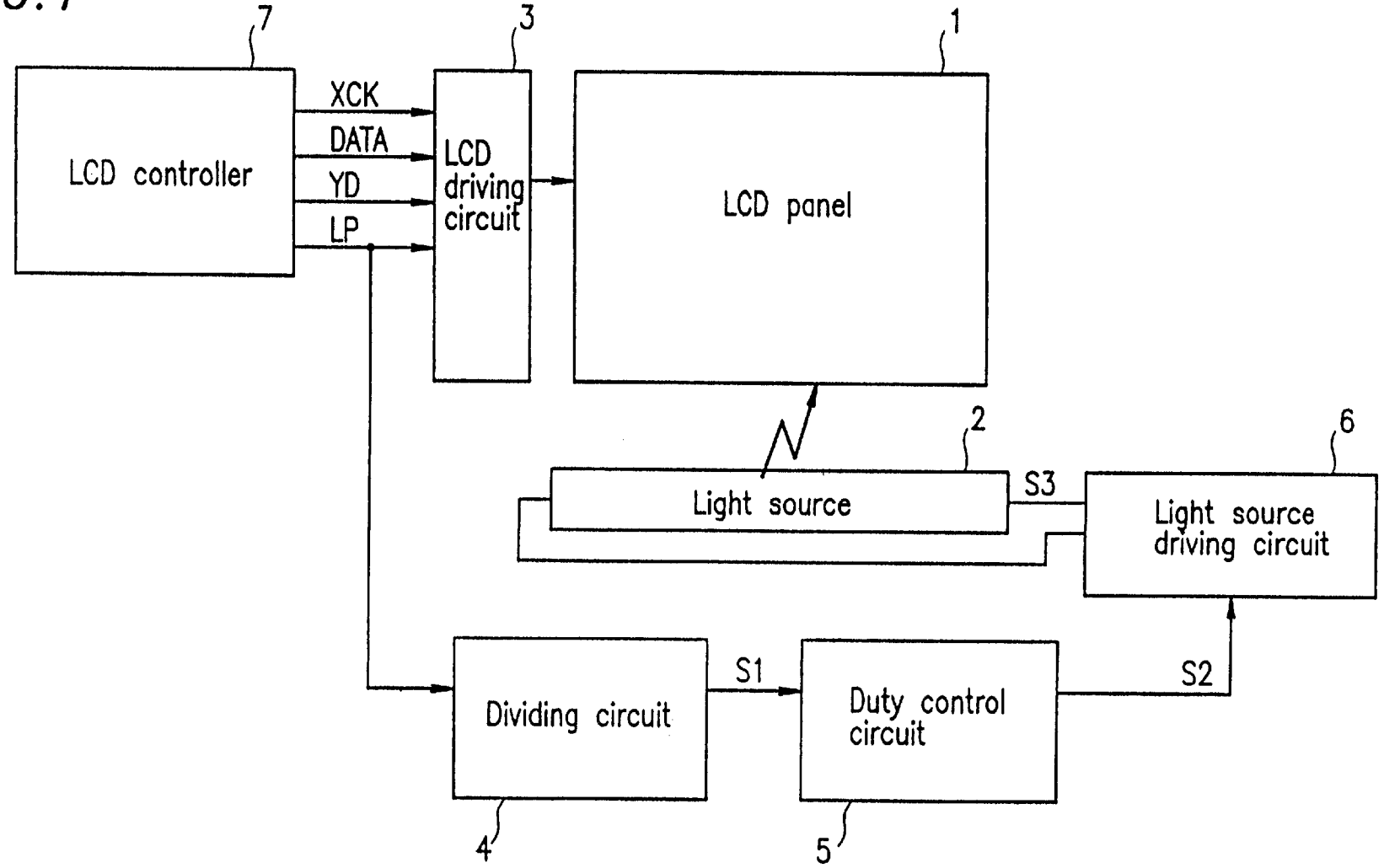
FIG. 1 is a block diagram showing a liquid crystal display (LCD) apparatus according to Embodiment 1 of the present invention.

An LCD apparatus according to Embodiment 1 is a simple matrix type LCD apparatus which includes, as shown in FIG. 1, a liquid crystal display panel 1 (hereinafter, referred to as the "LCD panel 1"), a light source 2 such as a cold cathode ray tube for illuminating the LCD panel 1, a liquid crystal display device driving circuit 3 (hereinafter, referred to as the "LCD device driving circuit 3"), a dividing circuit 4, a duty control circuit 5, a light source driving circuit 6, and an LCD controller 7.

The LCD controller 7 provides a display data signal DATA, and liquid crystal driving signals such as a display data transfer clock XCK, a scan start signal YD, a display data latch signal LP, and the like. The LCD device driving circuit 3 outputs a driving voltage to the LCD panel 1 based on the liquid crystal driving signals. The dividing circuit 4 divides the frequency of the display data latch signal LP by a division-number N (N is an integer greater than zero). The duty control circuit 5 changes an ON duty ratio of the frequency-divided signal from the dividing circuit 4 using the frequency of the frequency-divided signal as a reference frequency. The light source driving circuit 6 turns ON/OFF the light source based on the ON duty ratio set by the duty control circuit 5.

Next, operation of such an LCD apparatus will be described with reference to a timing chart shown in FIG. 2.

A simple matrix type LCD apparatus is typically driven by using the scan start signal YD and the display data latch signal LP. In FIG. 2, tLP represents a period of the display data latch signal LP. When the period of the scan start signal YD is (D×tLP), (1/D) is called the driving duty ratio (where D is not required to be equal to the number of dots in the vertical direction of the LCD apparatus, and is freely set to an integer as long as it satisfies the relationship D≧V).

Figure 2:
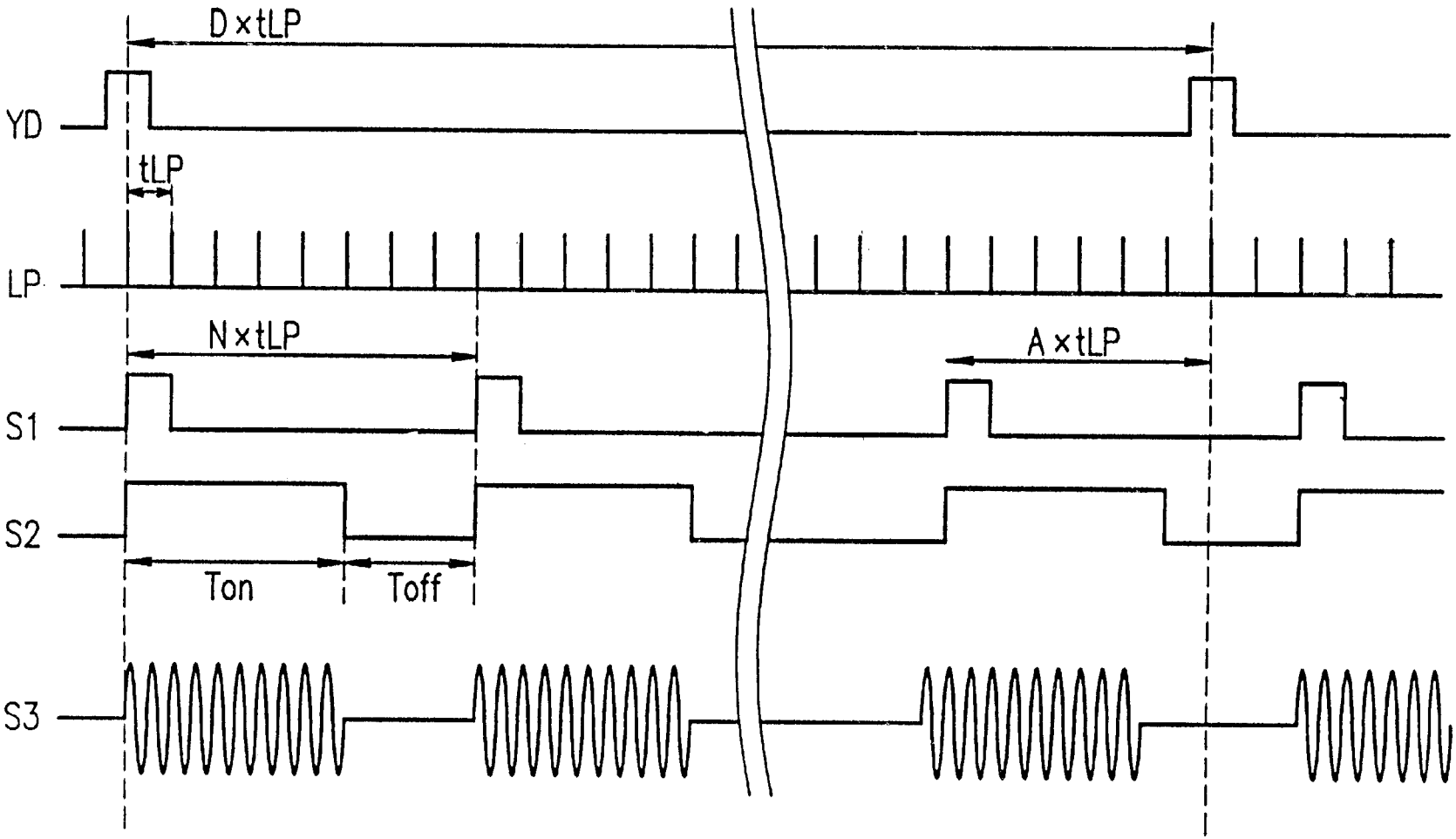
FIG. 2 is a timing chart showing signals used in an operation of the LCD apparatus according to Embodiment 1 of the present invention.

Referring again to FIG. 1, in conjunction with FIG. 2, the dividing circuit 4 divides the frequency of the display data latch signal LP to output a signal S1 having a period of (N×tLP) to the duty control circuit 5 (N is an integer greater than zero). The duty control circuit 5 changes the ON duty of the signal S1 to output a signal S2 having an ON duty of {Ton/(N×tLP)} to the light source driving circuit 6. The light source driving circuit 6 it turned ON/OFF its output voltage to be provided to the light source 2 based on the signal S2 (see signal S3). Thus, the light source 2 is alternately switched between emission and non-emission states at a period of (N×tLP).

According to Embodiment 1, flicker in the display can be reduced by setting the division-number N by a switch section 46 (FIG. 3) so as to satisfy Expression (1):

$$-1 \leqq \{(N/A)-2\} \leqq 1 \quad (1)$$

where A represents the remainder of D/N.

The remainder A is represented by Expression (2):

$$A=D-mN \quad (2)$$

where m is an integer equal to or smaller than (D−1).

In accordance with Expressions (1) and (2), the division-number N is set to be a value which satisfies the following Expression (3):

$$D/(1+m)<N<3D/(1+3m) \quad (3)$$

Consider a case where the driving duty D is 244, and m=8. In this case, the values for the division-number N that satisfy Expression (3) are 28 and 29.

When the division-number N is 28, the remainder A is obtained as follows:

$$D/N=244/28=8, \text{ remainder } 20 \quad (4)$$

Accordingly, Expression (1) is calculated as follows:

$$(N/A)-2=(28/20)-2=-0.6 \quad (5)$$

Thus, when the division-number N is set to 28, the value {(N/A)−2}(=−0.6) satisfies Expression (1).

When the division-number N is 29, the remainder A is obtained as follows:

$$D/N=244/29=8, \text{ remainder } 12 \quad (6)$$

Accordingly, Expression (1) is calculated as follows:

$$(N/A)-2=(29/12)-2=0.4 \quad (7)$$

Thus, when the division-number N is set to 29, the value {(N/A)−2}(=0.4) satisfies Expression (1). In such a manner, the division-number N is determined.

Figure 3:
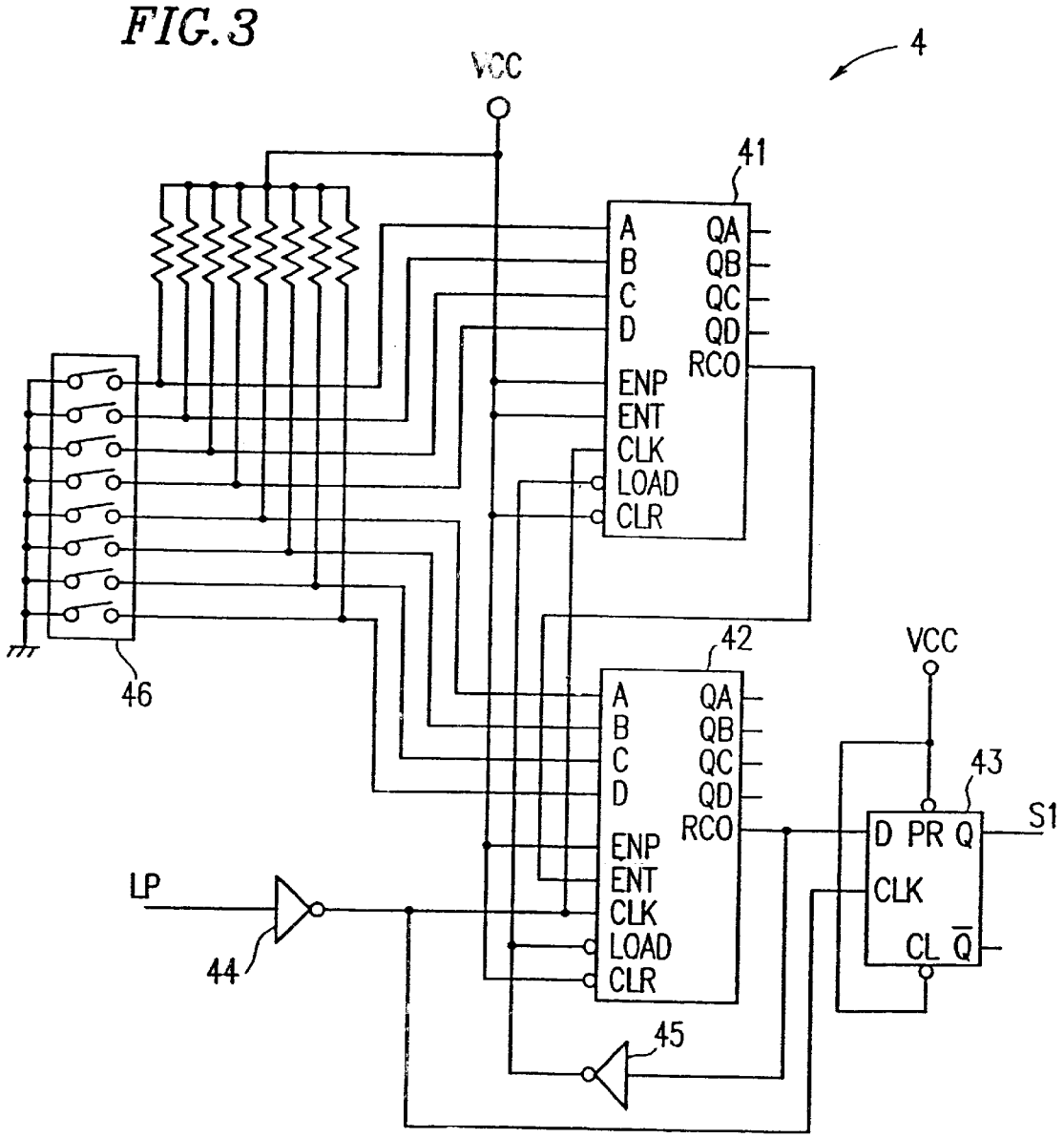
FIG. 3 is a circuit diagram showing an exemplary configuration of a dividing circuit of the LCD apparatus according to Embodiment 1 of the present invention.

Details of the dividing circuit 4 are now described. FIG. 3 shows an exemplary configuration of the dividing circuit 4. The dividing circuit 4 includes counters 41 and 42, a flip-flop 43, inverter circuits 44 and 45, and a switch section 46 for setting the division-number N.

In the dividing circuit 4, the division-number N is initially set with binary values through the switches 46. For every N falling edges of the display data latch signal LP counted by the counters 41 and 42, the counter 42 outputs a pulse from its carry output RCO. Based on the output pulse, the flip-flop 43 generates a signal S1 having a period of (N×tLPn), as shown in FIG. 2.

Figure 4:
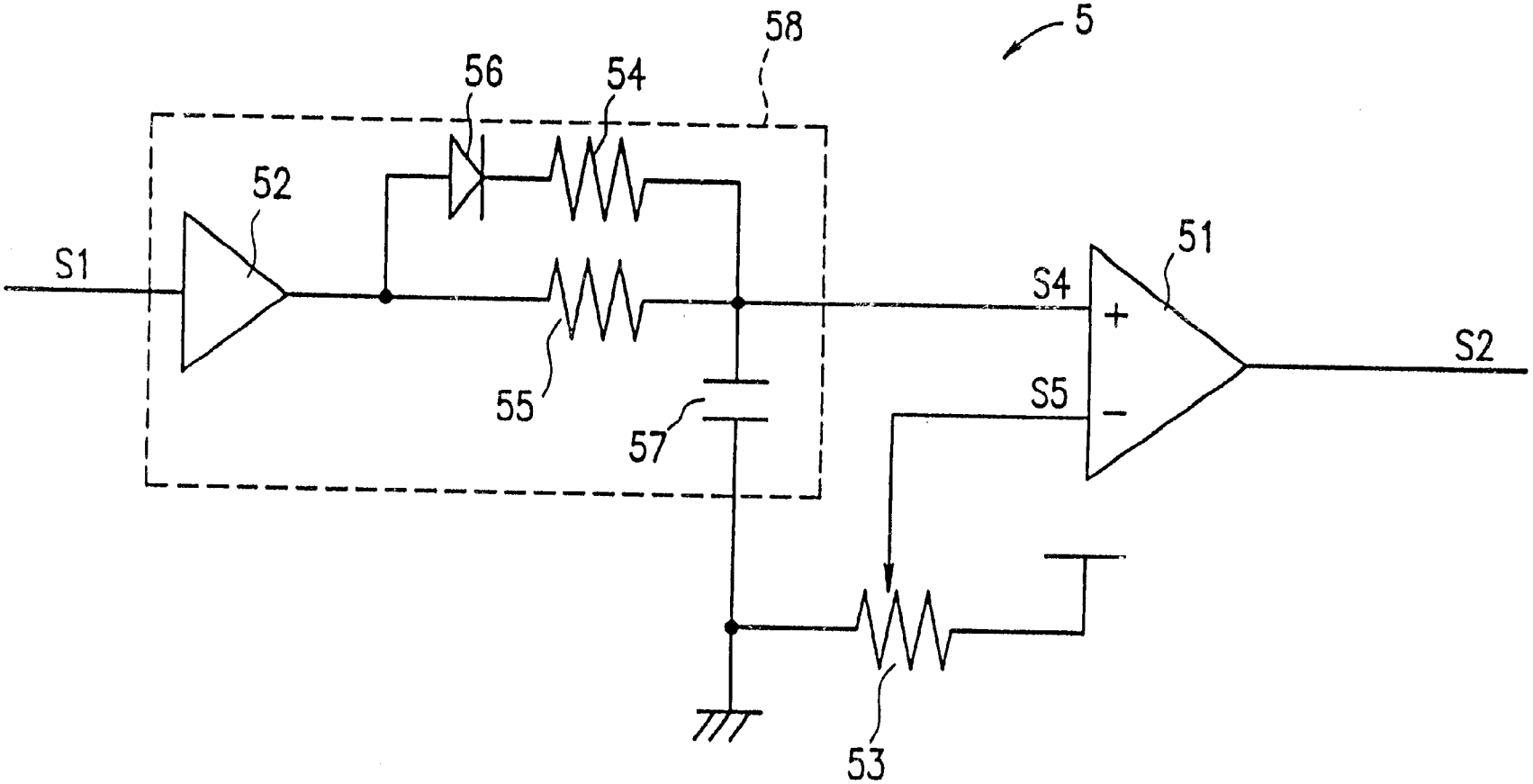
FIG. 4 is a circuit diagram showing an exemplary configuration of a duty control circuit of the LCD apparatus according to Embodiment 1 of the present invention.

FIG. 4 shows an exemplary configuration of the duty control circuit 5. The duty control circuit 5 includes a low-pass filter circuit 58, a variable resistor 53, and a comparator 51. The low-pass filter circuit 58 includes a buffer 52, a diode 56, resistors 54 and 55, and a condenser 57. Upon receiving a DC voltage S5 set by the variable resistor 53 and a signal S4 output from the low-pass filter circuit 58, the comparator 51 compares these signals with each other, and outputs the comparison result as a signal S2.

Figure 5:
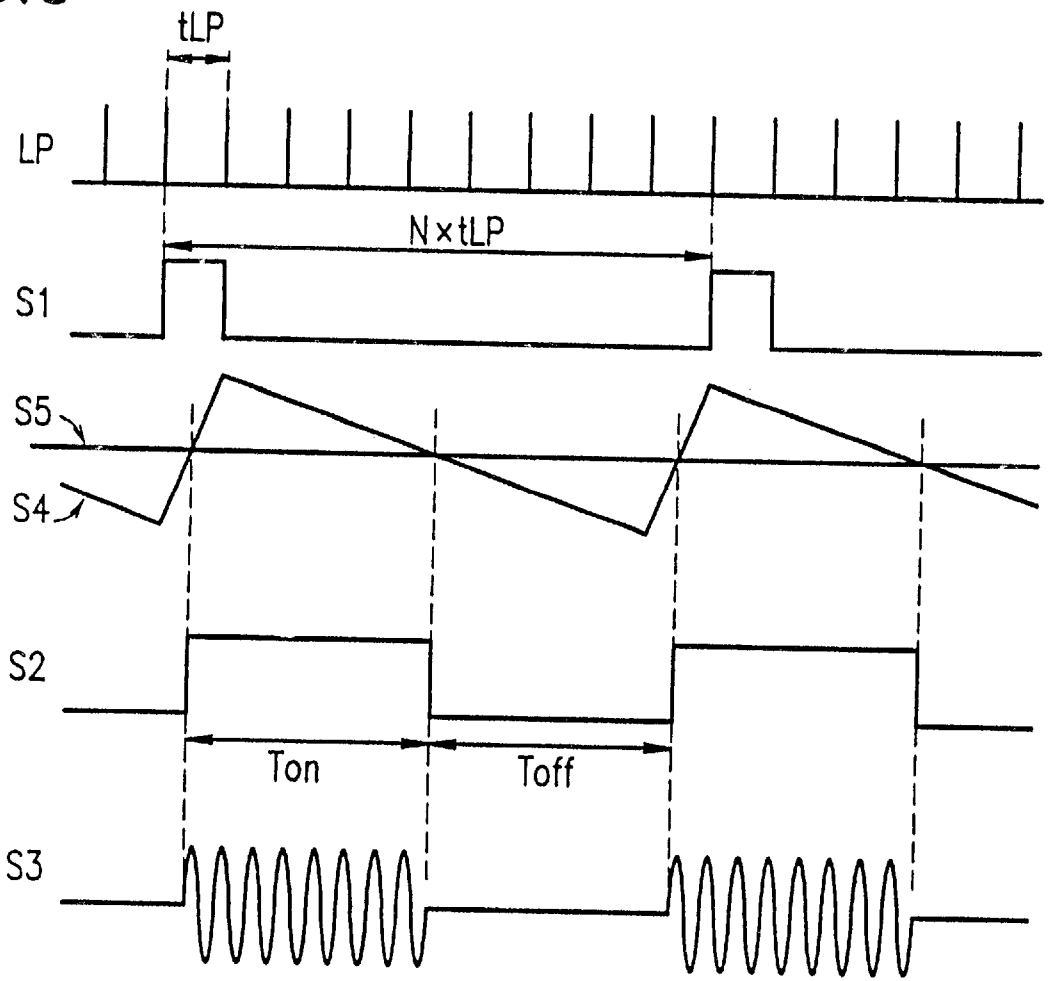
FIG. 5 is a timing chart showing signals used for an operation of the duty control circuit of the LCD apparatus according to Embodiment 1 of the present invention.

Next, an operation of the duty control circuit 5 will be described with reference to a timing chart shown in FIG. 5, in conjunction with FIG. 4.

Upon receiving the signal S1 having a period of (N×tLP), which has been obtained by dividing the frequency of the display data latch signal LP by the division-number N, the low-pass filter circuit 58 generates a triangular wave S4, and outputs the triangular wave S4 to the comparator 51. The comparator 51 compares the triangular wave S4 with the DC voltage S5 set by the variable resistor 53. Based on the comparison result, the comparator 51 generates the signal S2, which is high during a period wherein the triangular wave S4 exceeds the DC voltage S5. Thus, the ON duty of the signal S2 can be changed by adjusting the DC voltage 5. Upon receiving the signal S2, the light source driving circuit 6 outputs a voltage as shown as the signal S3 to the light source 2. The light source 2 operates based on the signal S3, i.e., alternately switched between emission and non-emission states at a period of (N×tLP).

As described above, according to the present invention, flicker in the display can be reduced by setting the division-number N at a value which satisfies Expression (1). Hereinafter, the principle of flicker reduction will be described with reference to FIGS. 6A through 6C.

Figure 6A:
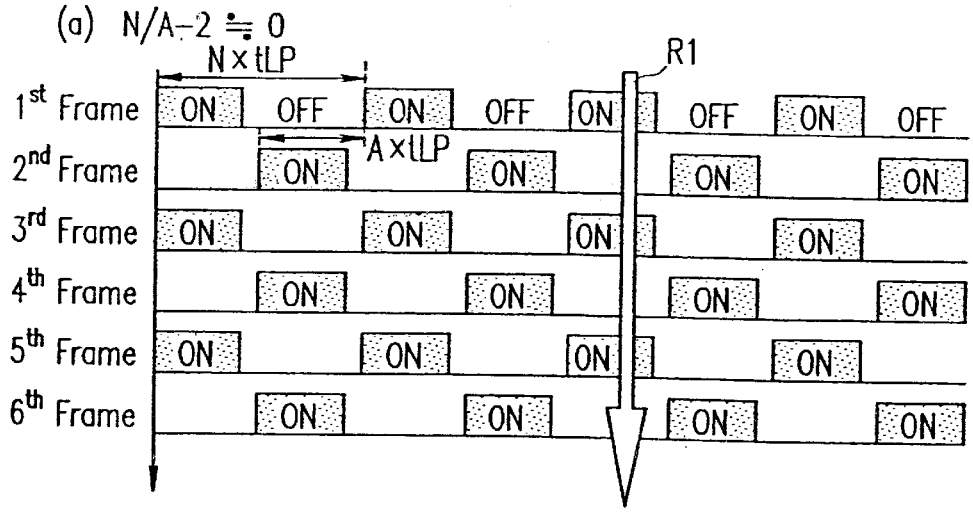
FIGS. 6A through 6C each illustrate principles for suppressing flicker in the display according to the present invention.
Figure 6B:
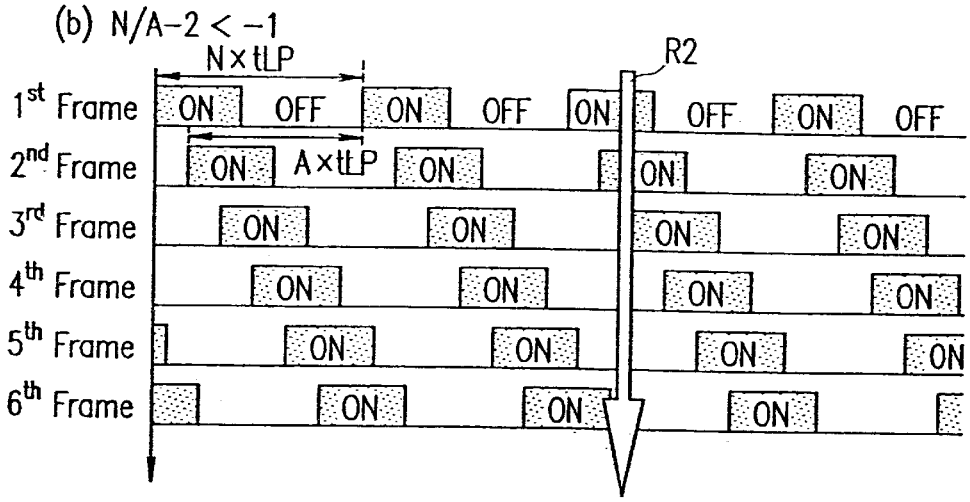
Figure 6C:
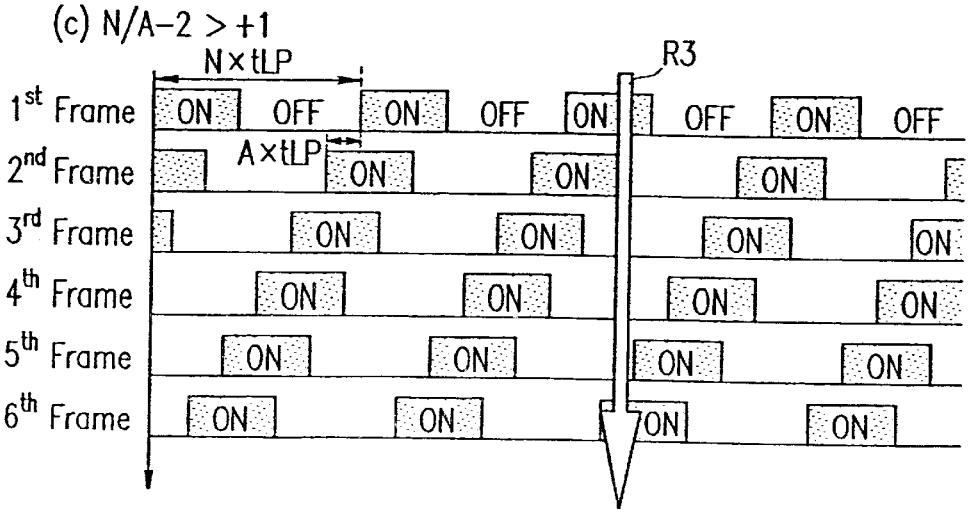

FIGS. 6A through 6C each illustrate a flashing operation of the backlight of the LCD apparatus when it is controlled based on the chopping light modulation method. FIGS. 6A through 6C respectively correspond to the following three cases; (a) (N/A)−2≈0;(b) (N/A)−2<−1; and (c) (N/A)−2>+1. Each of FIGS. 6A through 6C illustrates "ON-OFF" pattern of 1st to 6th frames.

Assume that a remainder of the driving duty D divided by N is A. Then, as shown in each of the drawings, the ON periods in the 2nd frame are offset with respect to those in the 1st frame by (A×tLP).

As shown in FIG. 6A, in case (a) where (N/A)−2≈0, the "ON-OFF" pattern is substantially "reversed" from one frame to another.

Thus, as indicated by arrow R1, the backlight is turned ON/OFF for every frame, and flashing occurs at any point on the screen. However, such flashing is not perceived by the human eye because the LCD apparatus is typically operated at a frame frequency which is equal to or greater than 60 Hz. Therefore, the display with reduced flicker can be realized.

On the other hand, as shown in FIG. 6B, in case (b) where (N/A)−2<−1, since the division-number N is closer to the value A, the ON period of the backlight in a frame is slightly delayed from that in the previous frame. Thus, Expression (1) is not satisfied. In this case, at any point on the screen, the apparent ON/OFF period of the backlight substantially increases and thus is perceived by the human eye, as indicated by arrow R2. Thus, the flashing cycle may be perceived by the human eye. Furthermore, an ON portion successively moves from one frame to another. When the entire screen is viewed, this may be perceived by the human eye as a movement of a horizontal stripe.

As shown in FIG. 6C, in case (c) where (N/A)−2>+1, the same phenomenon as in case (b) occurs except that the stripe moves in the reverse direction from that in case (b). Here also, Expression (1) is not satisfied.

Thus, flicker in the display can be suppressed by setting the division-number N at a value which satisfies Expression (1).

Furthermore, in the LCD apparatus of the present invention, a liquid crystal driving signal is also used as a light modulation signal. Accordingly, the relationship expressed by Expression (1) does not vary after the division-number is once set to a predetermined value, even when the reference frequency is varied due to temperature variations and/or aging of the LCD device. Thus, a stable display with reduced flicker can be realized.

(Embodiment 2)

An LCD apparatus according to Embodiment 2 of the present invention will be described with reference to FIGS. 7 through 9.

Figure 7:
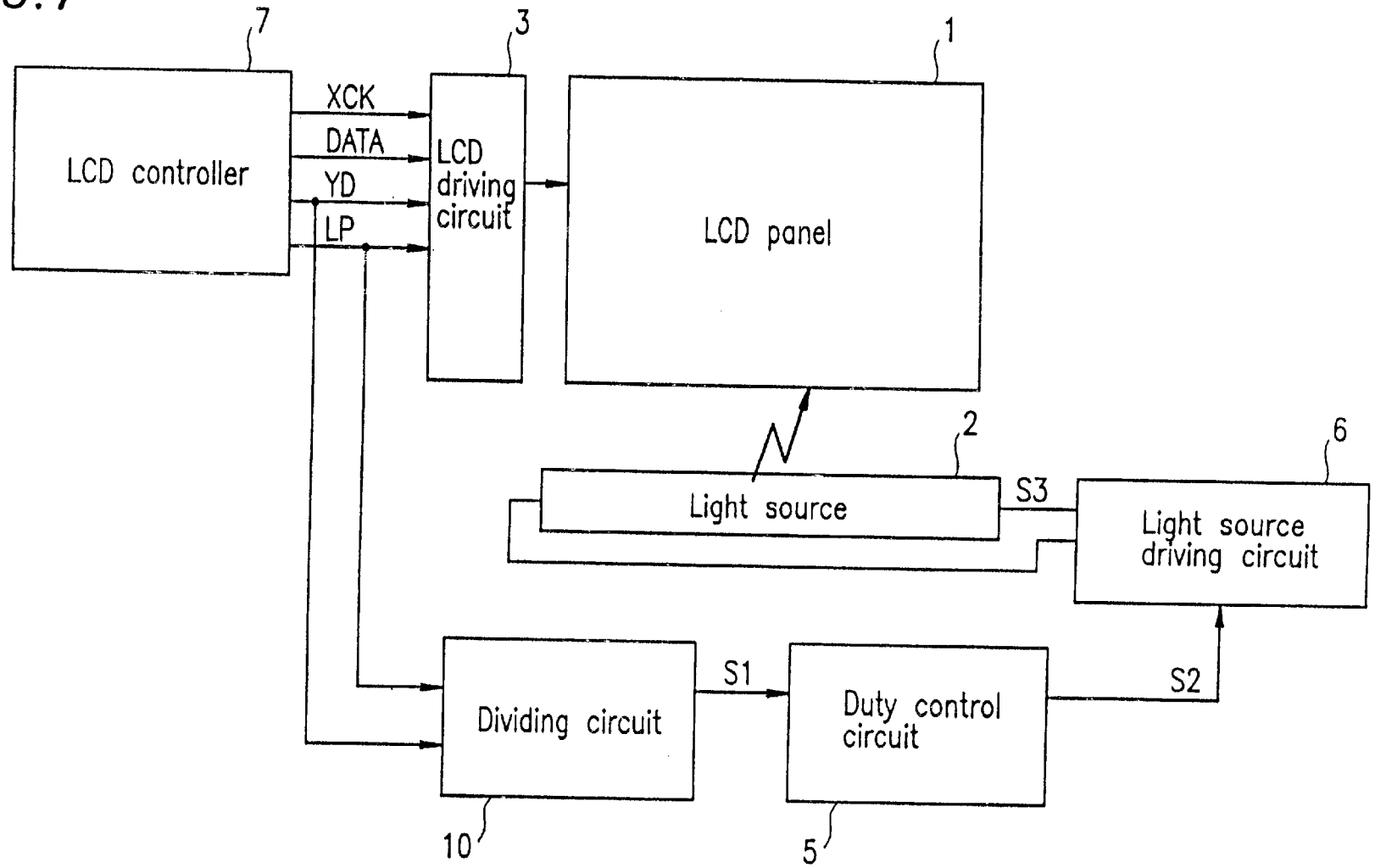
FIG. 7 is a block diagram showing an LCD apparatus according to Embodiment 2 of the present invention.

As shown in FIG. 7, the LCD apparatus according to Embodiment 2 has a configuration generally the same as that of Embodiment 1, except that the internal structure of a dividing circuit 10, and except that the dividing circuit 10 also receives the scan start signal YD in addition to the display data latch signal LP.

Figure 8:
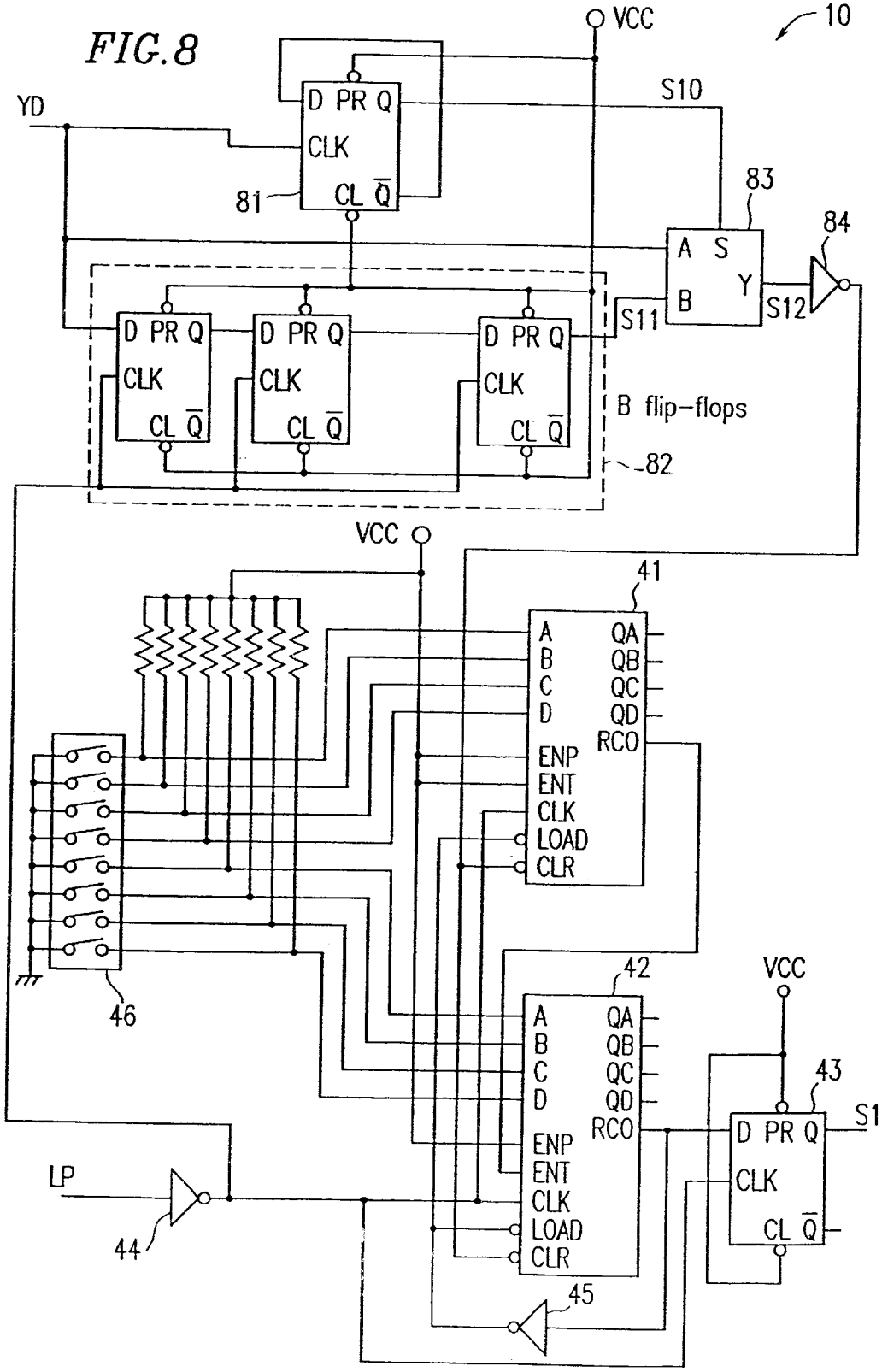
FIG. 8 is a circuit diagram showing an exemplary configuration of a dividing circuit of the LCD apparatus according to Embodiment 2 of the present invention.

FIG. 8 shows a particular, exemplary configuration of the dividing circuit 10. In addition to the components of the dividing circuit 4 shown in FIG. 3, the dividing circuit 10 includes another circuit including a flip-flop 81, a shift register 82, a selector 83, and a light source driving circuit 84. The other details as to the configuration of the dividing circuit 10 is same as those described in Embodiment 1.

The scan start signal YD received by the dividing circuit 10 is provided to the flip-flop 81 and the shift register 82 which is composed of B flip-flops. The flip-flop 81 divides the frequency of the signal YD so as to obtain a signal S10 having a ½ frequency of the signal YD. On the other hand, the shift register 82 shifts the signal YD through B stages by using the display data latch signal LP as a clock, outputting the shifted signal as a signal S11.

Upon receiving the signals S10 and S11, if the signal S1 is High, the selector 83 outputs the scan start signal YD from a terminal Y; whereas, if the signal S10 is Low, the selector 83 outputs the signal S11 from the terminal Y as a signal 612. The signal S12 output from the terminal Y is inverted by the light source driving circuit 84 and output to clear terminals CLR of the counters 41 and 42.

Thus, in the structure of the dividing circuit 10 shown in FIG. 8, every time two scan start signals YD are provided to the dividing circuit 10, i.e., at every two frames, the scan start signal YD (FIG. 9) and the signal S12 (FIG. 9) which has been obtained by offsetting the scan start signal YD by (B×tLP), are alternately input to the clear terminals CLR of the counters 41 and 42. The counters 41 and 42 are alternately reset based on the signal YD and the signal S12. Along with and based on such a reset operation, the frequency of the display data latch signal LP is divided by the division-number M set by the switch section 46, thereby generating an output signal S1 having the frequency of (M×tLP), as shown in FIG. 9.

The signal S1 is provided to the duty control circuit 5, as shown in FIG. 7. The duty control circuit 5 changes the ON duty of the signal S1, to generate a signal S2 having the ON duty of {Ton/(M×tLP)}, as shown in FIG. 9, and outputs the signal S2 to the light source driving circuit 6.

Figure 9:
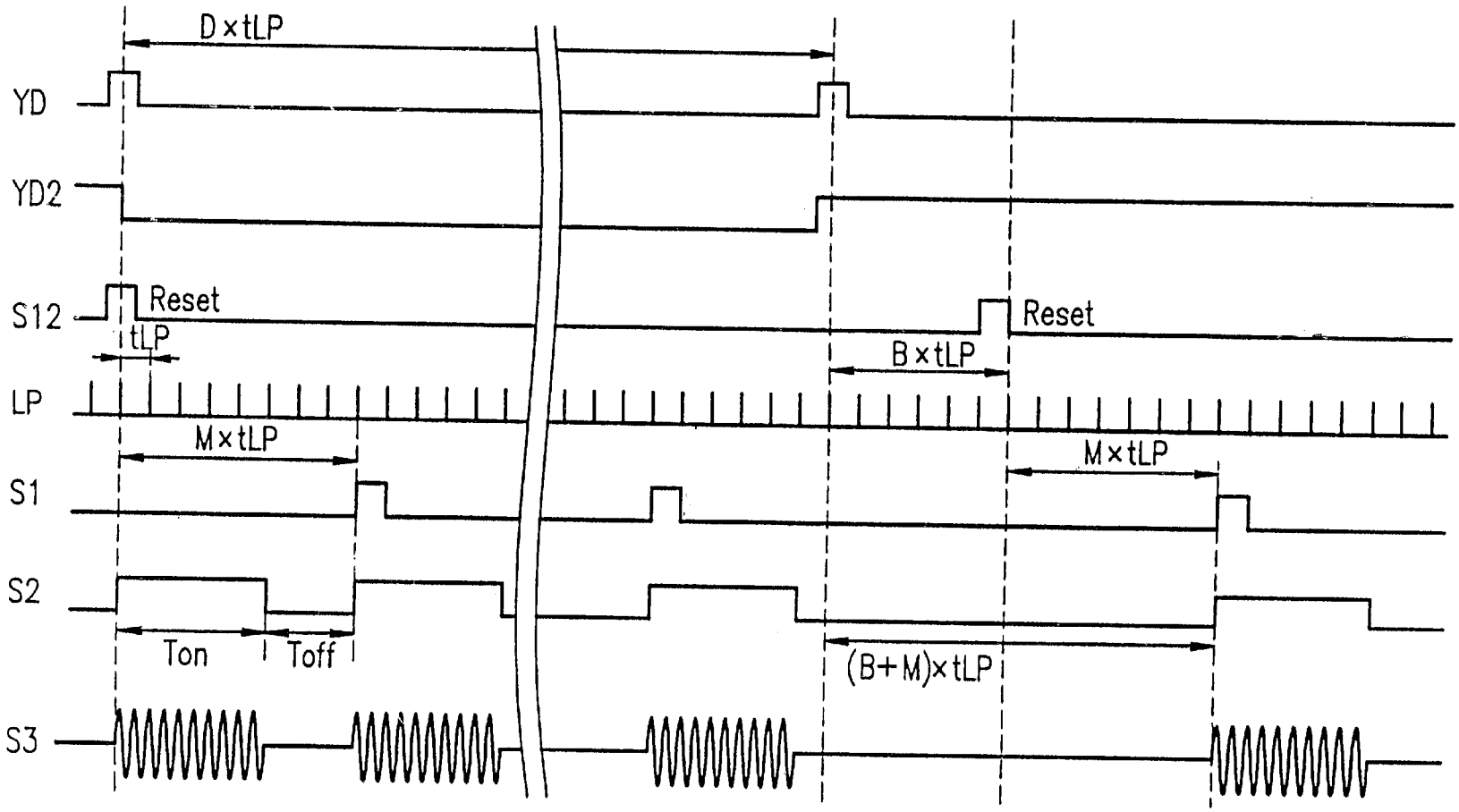
FIG. 9 is a timing chart showing signals used for an operation of a dividing circuit of the LCD apparatus according to Embodiment 2 of the present invention.

The light source driving circuit 6 turns ON/OFF the output to the light source 2 based on the signal S2, as illustrated by the signal S3 in FIG. 9. Thus, the light source 2 is alternately switched its emission and non-emission states at the period of (M×tLP).

If the value B is set so as to satisfy Expression 8:

$$-1 \leqq \{(M/B)-2\} \leqq 1, \tag{8}$$

the light source 2 operates in a manner as described above with reference to FIG. 6A. Thus, flicker in the display can be suppressed for the same reasons as described above.

Especially in this case, the value B can be set independent of the relationship between the division-number M and the driving duty of the display data latch signal or the horizontal synchronization signal. Thus, flicker in the display can be reduced under a wider variety of conditions.

Although, in Embodiment 2, the scan start signal YD and the scan start signal S12 which is shifted from the signal YD by (B×tLP) are used alternately for every two frames, the present invention is not limited to such a case. Needless to say, a rising edge of the signal with respect to the beginning of a frame may be offset by (B×tLP) with respect to the beginning of the previous frame while setting the value B so as to satisfy Expression (8).

(Embodiment 3)

Figure 10:
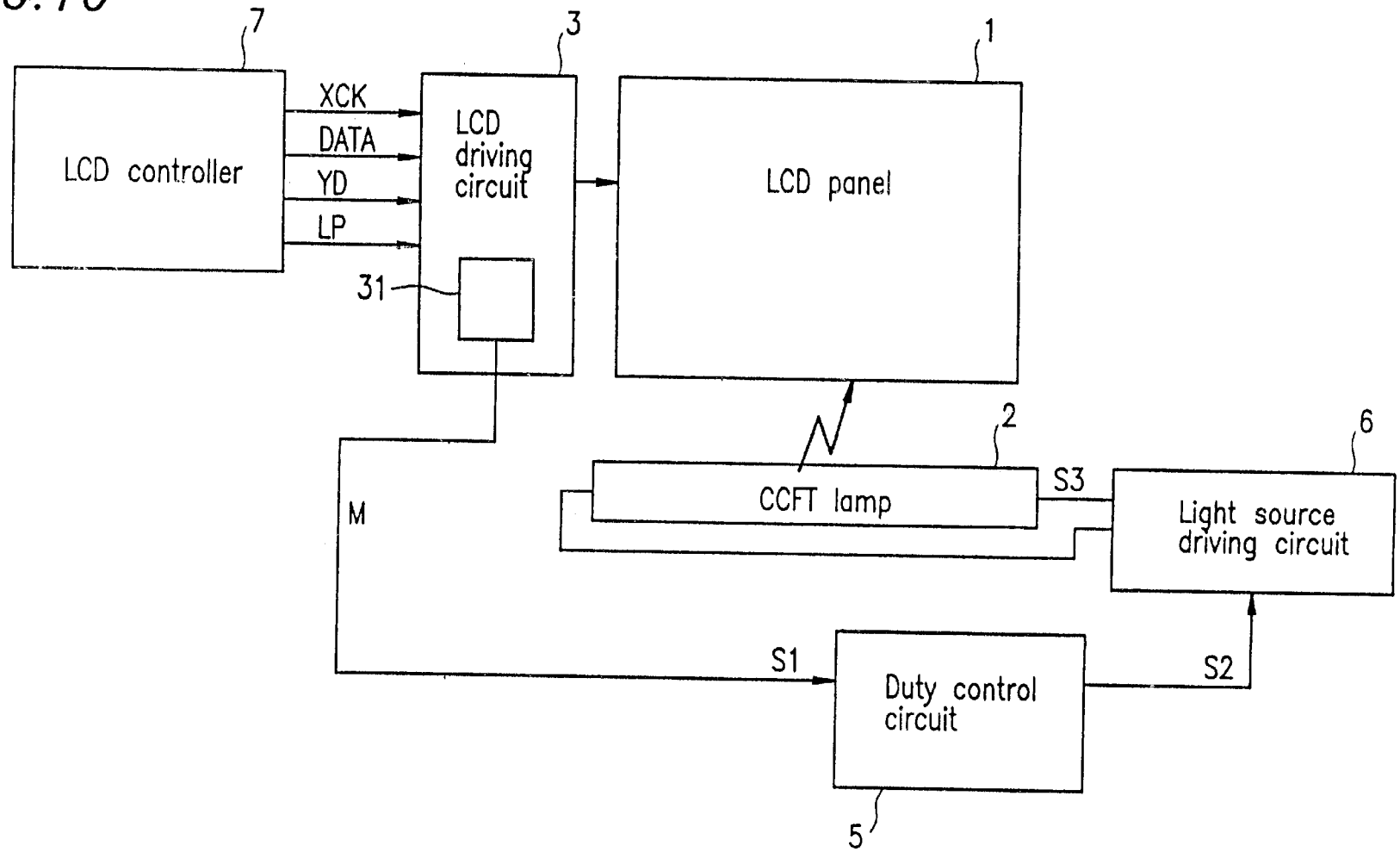
FIG. 10 is a block diagram showing an LCD apparatus according to Embodiment 3 of the present invention.

Next, Embodiment 3 of the present invention will now be described with reference to FIG. 10. The components which are identical with those used in Embodiment 1 will not be described herein.

The alternating signal generation circuit 31, which is typically employed in a simple matrix type LCD, divides the frequency of the display data latch signal LP by a predetermined number of counts, thereby generating a signal S1 and outputting the signal S1 to the duty control circuit 5.

In Embodiment 3, the alternating signal generation circuit 31 provides the alternating signal as a light modulation signal to the duty control circuit 5. Accordingly, a dividing circuit can be omitted. In this case, since the period of the alternating signal can be determined independent of the flashing of the backlight, it is only required to regulate the driving duty ratio of 1/D so that predetermined conditions are satisfied.

Although the simple matrix type LCD apparatus has been described in Embodiments 1–3, the present invention is not limited thereto. An active matrix type LCD apparatus, for example, may be employed as long as it includes a backlight.

(Embodiment 4)

Figure 11:
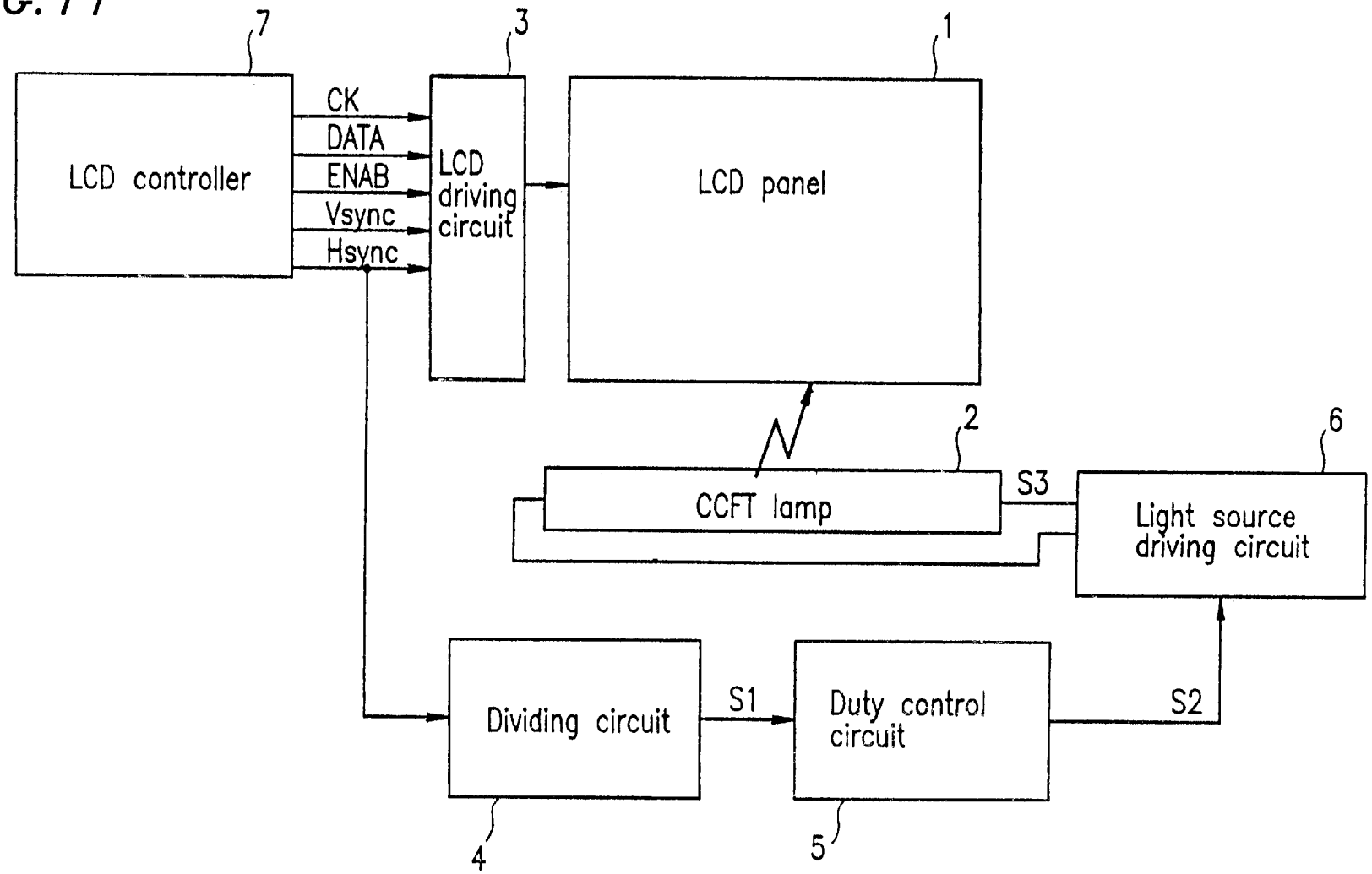
FIG. 11 is a block diagram showing an LCD apparatus according to Embodiment 4 of the present invention.
Figure 12:
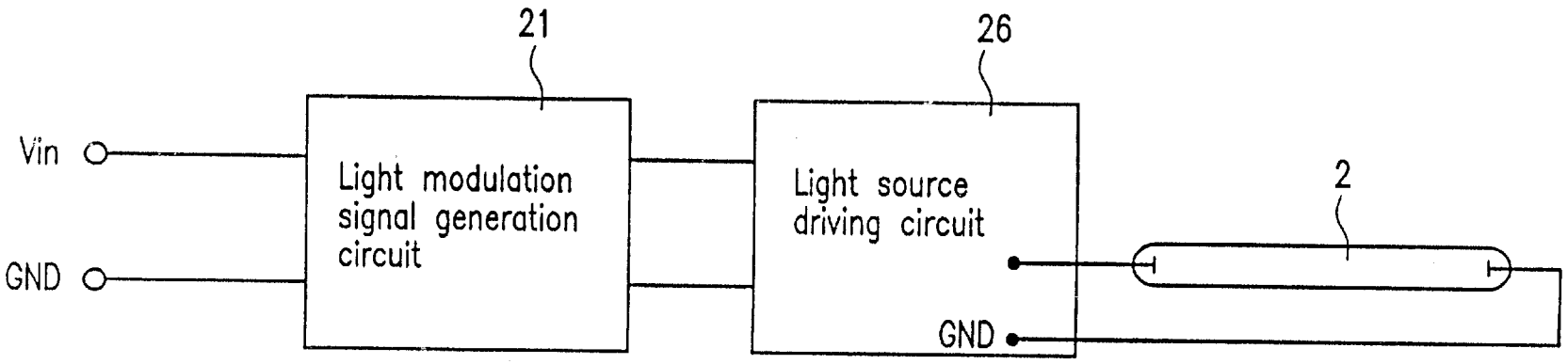
FIG. 12 PRIOR ART
FIG. 12 is a block diagram showing a back light according to Prior Art 1.
Figure 13:
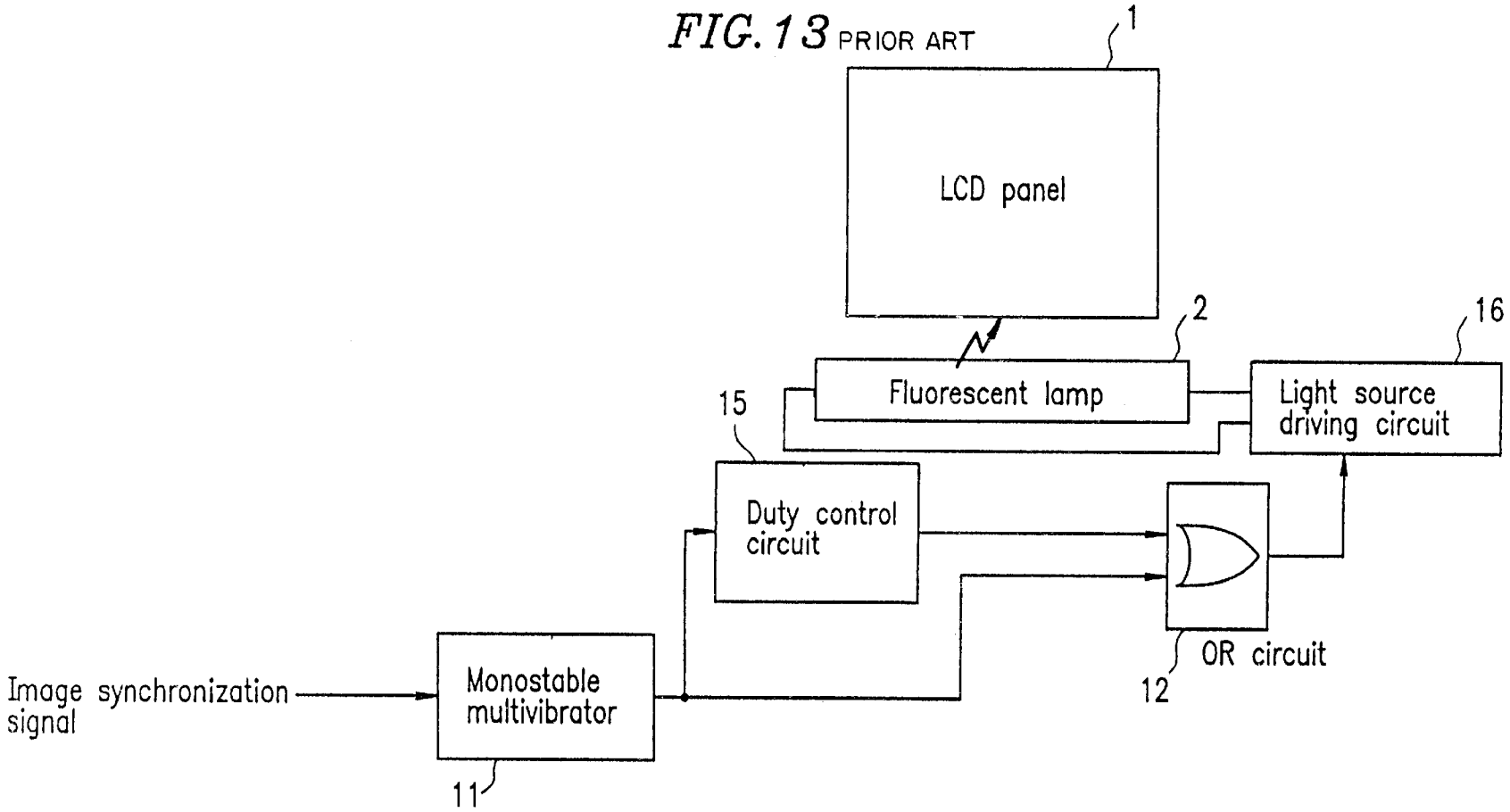
FIG. 13 PRIOR ART
FIG. 13 is a block diagram showing an LCD apparatus according to Prior Art 2.

Embodiment 4 of the present invention is now described with reference to FIG. 11, in which an active matrix type LCD panel is employed. In Embodiment 4, some of the signals provided from a controller 7 to an LCD device driving circuit 3 are different from those used in Embodiment 1 (FIG. 1). Specifically, a vertical synchronization signal Vsyno and a horizontal synchronization signal Hsyne are used in place of the scan start signal YD and the display data latch signal LP, respectively. In addition, the LCD device driving circuit 3 further receives a data enable signal ENAB from a controller 7. In the present embodiment, the dividing circuit 4 receives the horizontal synchronization signal Hsync and the data enable signal ENAB, and divides the frequency of the horizontal synchronization signal Hsync by the data enable signal ENAB to generate a signal S1. Subsequent operations of Embodiment 4 are same as those of Embodiment 1.

In Embodiments 1–4 described hereinabove, a light source which is employed as a backlight is not limited to the cold cathode ray tubes. A light emitting element such as a light emitting diode, an electroluminescent device, or the like, also can be used as the light source as long as light emitted therefrom can be modulated by controlling ON and OFF states of the light source.

The driving duty of the LCD apparatus rarely changes from the predetermined value during a normal operation. Thus, although the division-number N is manually set through the switches in the dividing circuit as shown in Embodiment 1, the present invention is not limited thereto. The division-number N may be calculated in any automatic manner so as to satisfy. Expression (1). In such a case, light can be modulated while reducing flicker in the display even when the driving duty varies.

Furthermore, arrangement of a dividing circuit, a duty control circuit, and components pertinent thereto in the LCD apparatus is not essential to the present invention. Therefore, any arrangement can be employed within the scope of the present invention. For example, all of those circuits may be incorporated in the LCD apparatus, or may be incorporated in the light source driving circuit.

Although, the present invention has been described using an LCD apparatus as an example, the present invention is not limited thereto. The principle of the present invention is applicable to an electronic apparatus for providing a control signal for use in the LCD apparatus.

As described above, in the LCD apparatus of the present invention, where (1/D) is the driving duty ratio, and "A" is the remainder of D/N, the division-number N is set so as to satisfy the following expression:

$$-1 \leqq \{(N/A)-2\} \leqq 1.$$

Alternatively, when a period of a vertical synchronization signal is M times as large as that of a horizontal synchronization signal, and "A" is the remainder of M/N, the division-number N and the value M are set so as to satisfy the following expression:

$$-1 \leqq \{(N/A)-2\} \leqq 1.$$

Alternatively, the frequency of the display data latch signal or the horizontal synchronization signal is divided by the division-number M by a dividing circuit so as to obtain a period of tLP, and a rising edge of a light modulation signal with respect to the beginning of the frame period is offset by (B×tLP) for every frame. In addition, the value B is set so as to satisfy the following expression:

$$-1 \leqq \{(M/B)-2\} \leqq 1.$$

Alternatively, where "A" is the remainder of period T1/period T2, the division-number N is set so as to satisfy the following expression:

$$-1 \leqq \{(T2/A)-2\} \leqq 1.$$

Under each of these conditions, the state of the light source is switched between ON and OFF for each frame at the frame frequency. Therefore, light can be optimally modulated while reducing flicker in the display perceived by the human eye.

Furthermore, even in the case where aging of the LCD apparatus, temperature variation, and/or any other variation in the condition has caused the frequency fluctuation in the signals for driving a LCD, the light modulation signal synchronizes with the fluctuated frequency. Thus, the light source can be driven in a stable manner free from any effect from such frequency fluctuation of the LCD driving signals. Accordingly, the display of the LCD panel with reduced flicker can be appropriately maintained.

In addition, the present invention provides the light modulation over a wide brightness range, which is a major feature of the chopping light modulation method.

According to Embodiment 4, the horizontal synchronization signal Hsyne is divided to be used as a light modulation signal, thereby reducing flicker in the display of an active matrix type LCD apparatus.

Especially in Embodiment 2, the value B can be set independent of the relationship between the division-number M of the display data latch signal or a horizontal synchronization signal and the driving duty, whereby flicker reduction can be realized under a wider variety of conditions.

Furthermore, flicker in the display can be reduced without a dividing circuit, by using a signal having a period T1 and a signal having a period T2.

In an electronic apparatus for driving an LCD apparatus of the present invention, where a driving duty ratio is 1/D, and a remainder of D divided by the division-number N is A, the electronic apparatus sets the division-number N so as to satisfy the following expression:

$$-1 \leqq \{(N/A)-2\} \leqq 1$$

Alternatively, where a cycle of a vertical synchronization signal is M times as large as that of a horizontal synchronization signal, and the remainder of the value M divided by the division-number N is A, the division-number N and the value M are set so as to satisfy the following expression:

$$-1 \leqq \{(N/A)-2\} \leqq 1.$$

Alternatively, a display data latch signal or a horizontal synchronization signal is divided by a division-number M through a dividing circuit so as to obtain a period of tLP, a rising edge of a light modulation signal with respect to the beginning of a frame period is offset by (B×tLP) at every frame, and the value B is set so as to satisfy the following expression:

$$-1 \leqq \{(M/B)-2\} \leqq 1.$$

Alternatively, where A is the remainder of a frame period T1 divided by another period T2, a division-number N is set so as to satisfy the following expression:

$$-1 \leqq \{(T2/A)-2\} \leqq 1.$$

Thus, the light source used in the LCD apparatus is turned ON/OFF at a frame frequency within each frame. Accordingly, a light provided to the LCD apparatus can be modulated so that flicker is not perceived by the human eye.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A liquid crystal display apparatus, comprising:

a liquid crystal display device;

a light source for illuminating the liquid crystal display device;

a LCD device driving circuit for providing a driving voltage to the liquid crystal display device based on a display data signal and a plurality of liquid crystal driving signals including a display data latch signal;

a dividing circuit for dividing a frequency of the display data latch signal by a factor of N so as to obtain a period which is N times as large as that of the display data latch signal, where N is an integer greater than zero;

a duty control circuit for changing an ON duty ratio of the frequency-divided signal by using the frequency-divided signal as a reference frequency; and a light source driving circuit for turning the light source ON/OFF based on a signal from the duty control circuit having the ON duty ratio set in the duty control circuit, wherein where a driving duty ratio is (1/D), and a remainder of D divided by the integer N is A, each of the integer N and the value D is set to an integer greater than zero which satisfies the following expression:

$$-1 \leqq \{(N/A)-2\} \leqq 1.$$

2. A liquid crystal display apparatus, comprising:

a liquid crystal display device;

a light source for illuminating the liquid crystal display device:

a LCD device driving circuit for providing a driving voltage to the liquid crystal display device based on a display data signal and a plurality of liquid crystal driving signals;

a dividing circuit for dividing a frequency of a horizontal synchronization signal having a period of one horizontal period, to obtain a period which is N times as large as that of the a horizontal synchronization signal, where N is an integer greater than zero;

a duty control circuit for changing an ON duty ratio of the frequency-divided signal by using the frequency-divided signal as a reference frequency; and a light source driving circuit for turning the light source ON/OFF based on a signal from the duty control circuit having the ON duty ratio set in the duty control circuit, wherein where a period of the vertical synchronization signal is M times as large as a period of the horizontal synchronization signal, and a remainder of M divided by N is A, each of the integer N and the value M is set to an integer greater than zero which satisfies the following expression:

$$-1 \leqq \{(N/A)-2\} \leqq 1.$$

3. A liquid crystal display apparatus, comprising:

a liquid crystal display device;

a light source for illuminating the liquid crystal display device;

a LCD device driving circuit for providing a driving voltage to the liquid crystal display device based on a display data signal and a plurality of liquid crystal driving signals including a display data latch signal;

a dividing circuit for dividing a frequency of the display data latch signal or a horizontal synchronization signal having a cycle of one horizontal period, to obtain a period which is M times as large as that of the display data latch signal or the horizontal synchronization signal, where M is an integer greater than zero;

a duty control circuit for changing an ON duty ratio of the frequency-divided signal by using the frequency-divided signal as a reference frequency; and a light source driving circuit for turning the light source ON/OFF based on a signal from the duty control circuit having the ON duty ratio set in the duty control circuit, wherein where a period of the display data latch signal or the horizontal synchronization signal is tLP, and a rising edge of a light modulation signal with respect to the beginning of a frame period is offset by (B×tLP), the value B is set to an integer greater than zero which satisfies the following expression:

$$-1 \leqq \{(M/B)-2\} \leqq 1.$$

4. A liquid crystal display apparatus, comprising:

a liquid crystal display device;

a light source for illuminating the liquid crystal display device;

a LCD device driving circuit for providing a driving voltage to the liquid crystal display device based on a display data signal and a liquid crystal driving signal having a frame period T1;

a duty control circuit for changing an ON duty ratio of a signal having a period T2;

a light source driving circuit for turning the light source ON/OFF based on a signal having the ON duty ratio set in the duty control circuit, wherein where a remainder of T1 divided by T2 is A, the values of T1 and T2 are set so as to satisfy the following expression:

$$-1 \leqq \{(T2/A)-2\} \leqq 1.$$

5. An electronic device for providing a control signal for use in a liquid crystal display apparatus, the device comprising:

means for providing a display data latch signal having a period of tLP;

means for providing a scan start signal having a period of D×tLP and a driving duty ratio of 1/D;

means for dividing a frequency of the display data latch signal by a division-number N so as to generate a frequency divided signal having a period of N×tLP; and means for outputting the control signal based on the frequency divided signal, wherein the value N and the value D are integer values, and where A is a remainder of D divided by the division-number N, the values D and the division-number N are selected so as to satisfy the following equations $$-1 \leqq \{(N/A-2\} \leqq 1.$$

6. An electronic device for providing a control signal for use in a liquid crystal display apparatus, the device comprising:

means for providing a vertical synchronization signal having a period M times as large as that of a horizontal synchronization signal;

means for dividing a frequency of the horizontal synchronization signal to obtain a frequency divided signal having a period which is N times as large as that of the horizontal synchronization signal; and means for outputting the control signal based on the frequency divided signal, wherein where A is a remainder of M divided by N, the values of N and M are selected so as to satisfy the following equation:

$$-1 \leqq \{(N/A)-2\} \leqq 1.$$

7. An electronic device for providing a control signal for use in a liquid crystal display apparatus, the device comprising:

means for providing a display data latch signal or a horizontal synchronization signal having a period of tLP;

means for providing a light modulation signal having a rising edge which is offset by B×tLP with respect to a frame period, the light modulation signal for controlling a division of the display data latch signal or horizontal synchronization signal;

means for dividing the display data latch signal or horizontal synchronization signal so as to obtain a frequency divided signal having a period of M×tLP; and means for outputting the control signal based on the frequency divided signal, wherein the value B is an integer value greater than zero and the values of B and M are selected so as to satisfy the following expression:

$$-1 \leqq \{(M/B)-2\} \leqq 1.$$

8. An electronic device for providing a control signal for use in a liquid crystal display apparatus, the device comprising:

means for providing a liquid crystal driving signal having a frame period T1; and means for changing an ON duty ratio of a signal having a period T2, wherein where A is a remainder of T1 divided by T2, the values T1 and T2 are selected to as to satisfy the following expression:

$$-1 \leqq \{(T2/A-2\}1.$$

* * * * *